United States Patent [19]

Thom

[11] Patent Number: 4,917,436

[45] Date of Patent: Apr. 17, 1990

[54] PICNIC TABLE WITH WHEELCHAIR AND CHAIR ACCESS

[75] Inventor: Howard L. Thom, Laurel, Mont.

[73] Assignee: Thom's Inc., Laurel, Mont.

[21] Appl. No.: 337,748

[22] Filed: Apr. 13, 1989

[51] Int. Cl.[4] ..... A47B 39/00

[52] U.S. Cl. ..... 297/157; 297/233; 297/DIG. 4

[58] Field of Search ..... 297/174, 233, 157, 158, 297/159, 140, DIG. 4; 312/239, 235, 278; 108/90

[56] References Cited

U.S. PATENT DOCUMENTS

| | | | |
|---|---|---|---|
| 433,623 | 8/1890 | Hunzinger | 297/140 |
| 1,322,132 | 11/1919 | Novomiroff | 108/78 |
| 1,951,619 | 3/1934 | MacDonald | 297/442 X |
| 2,030,195 | 2/1936 | Breese | 297/140 X |
| 2,206,422 | 7/1940 | Nummey | 312/235 R |
| 3,300,245 | 1/1967 | Rumble | 297/157 |
| 3,572,824 | 3/1971 | Schupbach et al. | 297/157 |
| 3,822,078 | 7/1974 | Spadolini | 297/140 |
| 4,237,796 | 12/1980 | Gordon | 312/239 X |
| 4,607,880 | 8/1986 | Gastebled | 297/157 |
| 4,700,986 | 10/1987 | Davis et al. | 297/157 |

*Primary Examiner*—James T. McCall

*Attorney, Agent, or Firm*—Fleit, Jacobson, Cohn, Price, Holman & Stern

[57] ABSTRACT

A picnic table having attached bench seats around the periphery thereof with one segment of the bench seat being removable to enable access to the periphery of the table by a person occupying a wheelchair or a conventional chair. The picnic table surface is provided with an extension in the access area to extend the edge of the table radially outwardly to render it more accessible to a person occupying a wheelchair or chair. The bench seat component along a portion of the periphery of the chair is attached by bracket structures which enable it to be removed as a unit and stored in a convenient location to enable the wheelchair or chair to be inserted between the end portions of the bench seats that define an open area around the periphery of the table with the extension on the table surface being aligned with the open space defined by removal of the segment of the bench seat.

8 Claims, 2 Drawing Sheets

PICNIC TABLE WITH WHEELCHAIR AND CHAIR ACCESS

BACKGROUND OF THE INVENTION

1. Field of the Invention

The present invention generally relates to a picnic table having an attached bench seat around the periphery thereof with one or more segments (not over four segments) of the bench seat being removable to enable access to the periphery of the table by a person occupying a wheelchair or a conventional chair. The picnic table surface is provided with an extension in the access area to extend the edge of the table radially outwardly to render it more accessible to a person occupying a wheelchair or chair. The removable bench seat segment or segments which extend along a portion of the periphery of the table are attached by bracket structures which enable removal as a unit for storage in a convenient location to enable a wheelchair or chair to be inserted between the end portions of the bench seats that define the access area or areas with an extensions on the table surface being aligned with each access area defined by removal of a segment of the bench seat.

2. Description of the Prior Art

Prior U.S. Pat. No. Des. 266,211 issued Sept. 21, 1982 discloses a picnic table having multiple side elements and preferably octagonal with a bench seat and appropriate supports being fixedly attached to and supporting the picnic table. While this picnic table is adequate for most purposes and has received considerable commercial success, there is a desire to provide access to the picnic table by a person occupying a wheelchair or a chair. The prior art does not disclose such a structure.

SUMMARY OF THE INVENTION

An object of the present invention is to provide a picnic table having a peripheral bench seat attached to the picnic table and forming a integral part thereof with one or more segments of the bench seat being removably supported to enable it to be easily removed thereby providing radial access to the picnic table surface by a person occupying a wheelchair or by a person setting in a conventional chair thereby enabling the picnic table to be more serviceable to occupants of a wheelchair or chair.

Another object of the invention is to provide a picnic table in accordance with the preceding object in which the segment of the picnic table surface in alignment with the access area formed by removal of a segment of the bench seat is provided with a removable extension on the outer periphery thereof to extend the picnic table surface to render the table top surface more accessible to a wheelchair occupant or the occupant of a chair.

A further object of the invention is to provide a picnic table in accordance with the preceding objects having the bench seat segments that are removable connected together as an assembly and providing bracket structures removably interlocking the removable bench seat segments and the supporting structure for the picnic table.

Still another object of the invention is to provide a picnic table with radial access being provided by removal of a segment of a bench seat attached to the picnic table which is relatively simple to operate with the removable segment of the bench seat being secured locked in place to provide a sturdy picnic table with a continuous bench seat peripherally thereof but which can be converted to wheelchair access by removal of a segment of the bench seat with the removal requiring very little time and effort.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
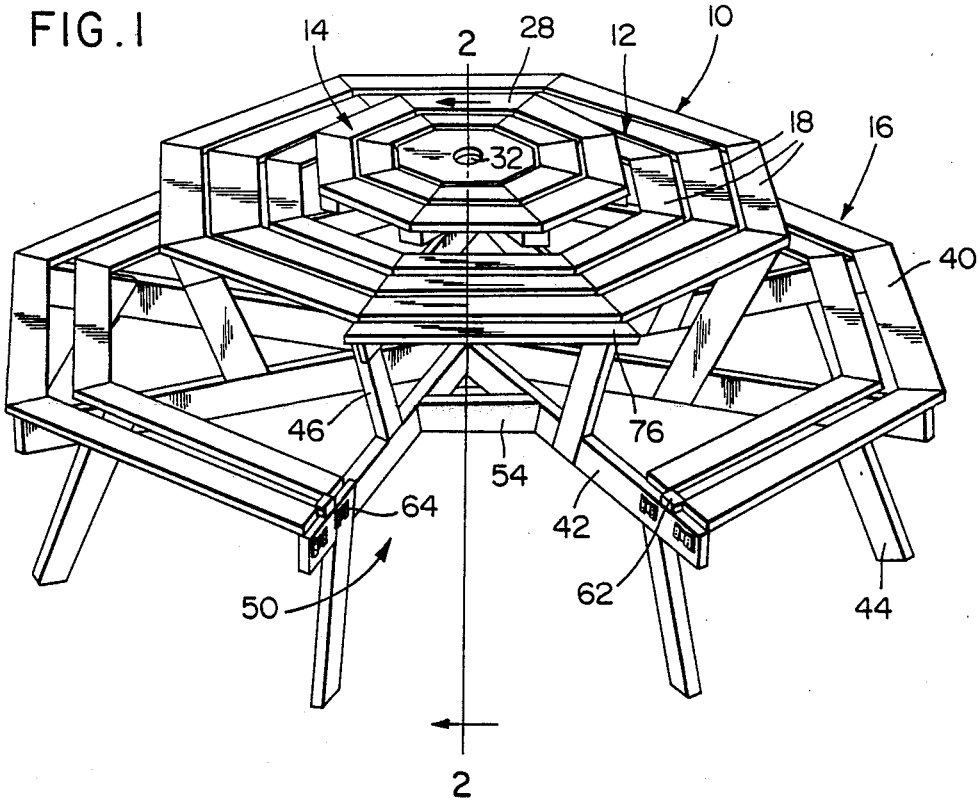
FIG. 1 is a perspective view of the picnic table of the present invention illustrating the wheelchair access area open to receive a wheelchair.

Referring now to the drawings, the picnic table of the present invention is generally designated by reference numeral 10 and is shown as an octagonal table although the number of sides may vary and the picnic table generally is constructed in the manner of the above-mentioned U.S. Pat. No. Des. 266,211.

Figure 2:
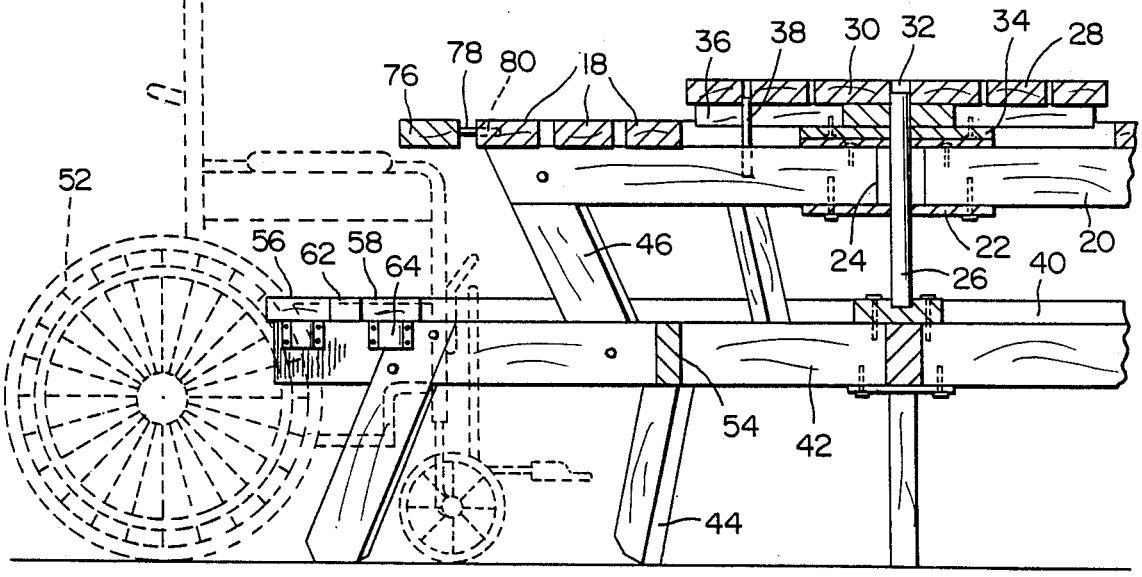
FIG. 2 is a vertical, sectional view, on an enlarged scale, taken substantially upon a plane passing along section line 2—2 on FIG. 1 illustrating specific structural details of the wheelchair access area of the picnic table.

The table 10 includes a table top member 12, an optional rotatable lazy susan structure 14 and a peripheral bench seat 16 extending around the periphery of the table top 12 at an elevation lower than the table top to permit individuals to be supported on the bench seat while eating or otherwise using the table top 12. As illustrated, the table top 12, lazy susan and bench arrangement are octagonal in plan configuration. The table top 12 includes a plurality of short wood members 18 which increase in length from the inner members toward the outer with the wood members 18 being supported by radially extending support members or frame members 20 having their inner ends interconnected by connector plates 22 thus providing an opening 24 for receiving a shaft, tube or pipe 26 which guides and rotatably retains the lazy susan 14 on the table top 12. The lazy susan 14 is constructed in a similar manner of a plurality of wood members 28 with a center member 30 having an aperture 32 therein which receives the shaft or pipe 26 as illustrated in FIG. 2 with a suitable bearing structure 34 being provided to support the lazy susan. The lazy susan includes radial support members 36 which interconnect and support the wood members and a lock pin 38 is provided for the lazy susan to prevent it from rotating when it is desired to maintain it stationary. This structure of the picnic table is conventional and disclosed in prior U.S. Pat. No. Des. 266,211.

The bench seat 16 also includes a pair of wood members 40 forming a continuous bench seat when a plurality of such members are arranged peripherally of the table top 12. The wood members 40 are supported by radial frame members 42 with depending and outwardly inclined support legs 44 connected thereto with the frame members 42 underlying and connecting the adjacent ends of the angularly related wood members 40. Downwardly and inwardly inclined support frame members 46 extend from the outer periphery of the table top 18 downwardly into engagement with the radial frame members 42.

Figure 3:
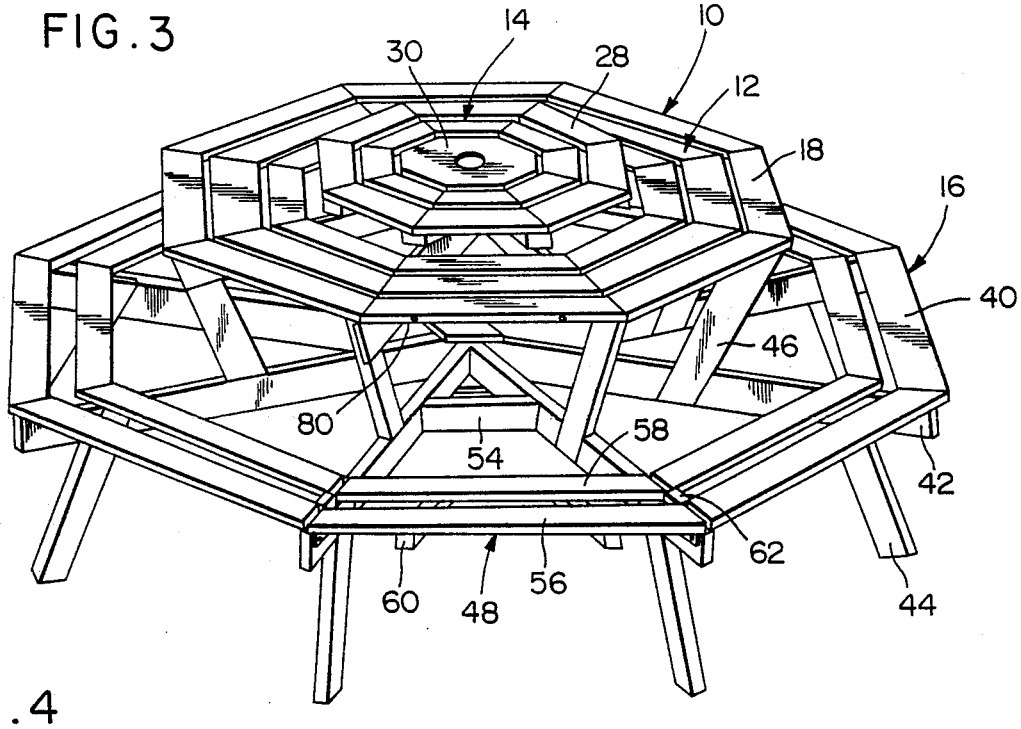
FIG. 3 is a perspective view of the picnic table similar to FIG. 1 but illustrating the removable bench seat segment in place on the table to form a continuous peripheral bench seat on the picnic table.
Figure 4:
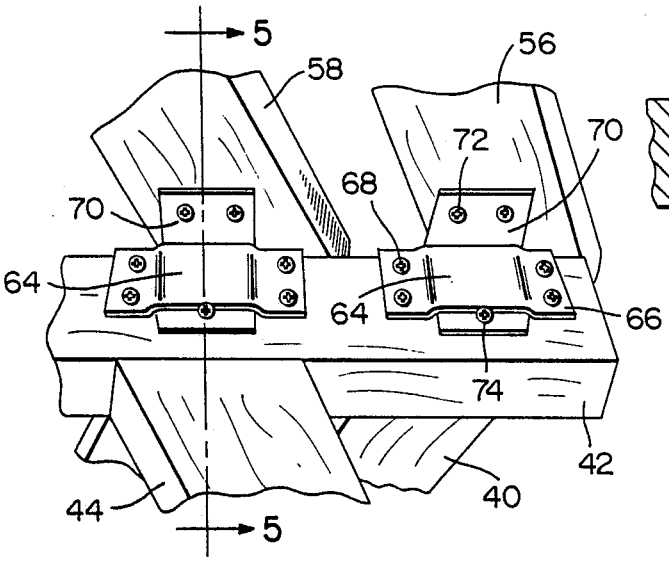
FIG. 4 is a fragmental, bottom perspective view of the removable bench seat segment illustrating the manner in which it is attached to the supporting framework for the picnic table.
Figure 5:
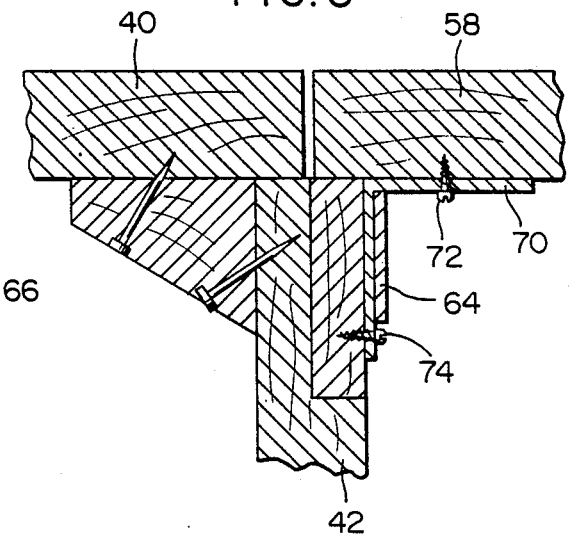
FIG. 5 is a vertical, sectional view taken substantially upon a plane passing along section line 5—5 on FIG. 4 illustrating further structural details of the bracket structure for the removable bench seat segment.
Figure 6:
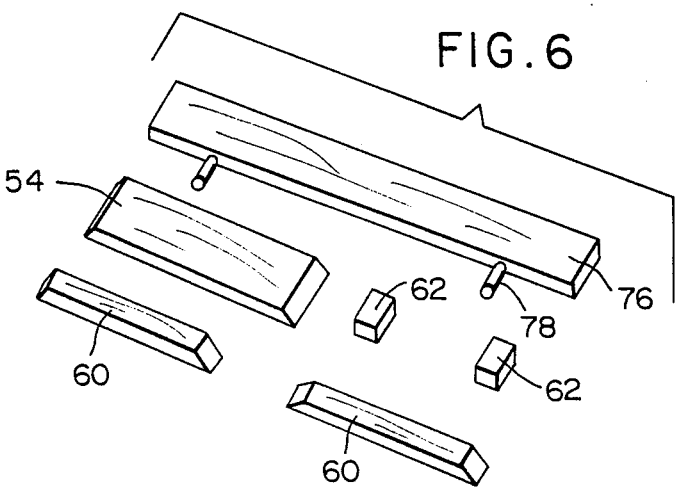
FIG. 6 is an exploded group perspective view illustrating the components of the table surface extension, brace, bench seat component connectors and locating blocks for the bench seat segment that is removable.

As illustrated in FIG. 3, when all of the wood members are in place, the peripheral bench seat 16 is continuous. However, the bench seat segment generally designated by reference numeral 48 which extends between one adjacent pair of radial frames 42 is removable to provide an access area 50 thereby enabling a wheelchair 52 to closely approach the periphery of the table top 12 as illustrated in FIG. 2 with the distance between the outer ends of the frame members 42 being sufficient to enable the wheelchair wheels to move into this area with the forward end of the wheelchair extending to a point closely adjacent a horizontally extending brace 54 that interconnects the radial pair of frames 42 which define the space 50. The brace 54 is a wood member secured to the frame members 42 to rigidify the frame members to provide a sturdy construction when the removable seat segment has been removed.

The removable seat segment includes a pair of spaced parallel wood members 56 and 58 which are the same shape and size as the wood members 40. The two wood members 56 and 58 are rigidly interconnected and maintained in assembled and spaced relation by a pair of spaced cleats 60 secured to the underside of the wood members 56 and 58. The top surface of the frame members 42 defining the space 50 each includes a block 62 secured thereto with the block extending between the adjacent ends of the wood members 56 and 58 and adjacent wood members 40 to position and align the wood members 56 and 58 with the adjacent wood members 40.

To removably secure the wood members 56 and 58 to the frame members 42, the inner surface of the frame members 42 which face the space 50 include a pair of bracket structures 64 which have a pair of offset end portions 66 secured to the surface of the frame member 42 by fasteners 68 thus leaving a central portion of each bracket strap spaced slightly from the surface of the frame member 42. The underside of each wood member 56 and 58 is provided with an L-shaped bracket 70 secured to the wood members 56 and 58 by fasteners 72 with the depending flange of the L-shaped bracket 70 being slidably interlocked with the bracket strap 64 by downward vertical movement of the wood members 56 and 58 thereby locking the wood members 56 and 58 in place. In order to prevent accidental removal of the wood members 56 and 58, a fastening device 74 can be inserted through the lower end of the flange of the bracket 70 which extends through the bracket strap 64 to prevent upward movement of the bracket 70 in relation to the bracket strap 64 thereby rigidly securing but yet enabling detachment of the wood members 56 and 58 when the fastener 74 is removed.

In order to facilitate access to the table top by the occupant of a wheelchair or by the occupant of a conventional straightback chair, one segment of the table top 12 includes an extension 76 in the form of a wood member generally corresponding to the wood members 18 although being slightly longer. The inner edge of the wood member 7 is provided with a pair of projecting pins or dowels 78 that are telescopically and frictionally received in sockets 80 formed in the outer edge of the outermost wood members 18 of the table top 12 thereby enabling the extension 76 to be positioned in alignment with the outermost wood member 18 of the table top in the position illustrated in FIGS. 1 and 2. The extension 76 can be removed so the table top will be provided with a symmetrical periphery as illustrated in FIG. 3 when the removable bench seat segment 48 is in place as illustrated in FIG. 3 inasmuch as the extension 76 is not necessary when the bench seat segment 48 is in place inasmuch as the occupant of the bench seat segment 48 will not need the extension 76.

The removable bench seat segment 48 and the additional extension 76 provide accessibility to wheelchairs or chairs thereby enabling the table to be receptive to handicapped people. The bracket structures to hold the removable seat segment or segments in place provide a secure mounting but other means can be used to accomplish the retention of the removable seat segment 48 in place including relative simple hooks and eyes with one of the components of the hook and eye being secured to the radial frame and the other component secured to the undersurface of the removable wood members 56 and 58. All of the components except for the removable seat segment 48 and the extension 76 are rigidly and permanently secured together by nails, bolts or any suitable fastening arrangements. The wheelchair access opening is defined by the removable bench seat segment 48 and enables the picnic table and bench to be converted from a continuous bench arrangement to an interrupted bench that provides access to the periphery of the table top to a handicapped person in a wheelchair or enables a straightback chair or the like, folding chair or other similar type chair to be positioned in adjacent relation to the table top to enable an occupant of that chair to have better access to the table top. This eliminates the necessity of a person stepping over the rigidly mounted bench seat segments which can be a problem especially to the elderly and those that may have some degree of handicap. This structure enables the picnic table to satisfy the requirements of access to a picnic table by the handicapped and provides a rigid and sturdy structure for this purpose.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A table comprising a table top having a continuous periphery, a bench seat extending around the periphery of the table with the table and bench seat being interconnected and supported from a support surface, said bench seat being continuous and including at least one removable segment, means detachably supporting the removable segment from the bench seat to enable removal of the removable bench segment to provide access to the periphery of the table top by a wheelchair or a straightback or similar chair, said bench seat being supported by a plurality of radial frame members with the removable bench seat segment being connected to the outer end portions of two adjacent radial frame members.

2. The structure as defined in claim 1 wherein said means detachably supporting the bench segment includes loop-type brackets on the opposed surfaces of adjacent radial frame members, said removable seat segment including depending brackets at each end for interlocking engagement with the loop-type brackets on the frame members to enable the removable seat segment to be retained in place.

3. The structure as defined in claim 2 wherein the removable seat segment includes a pair of wood members, the remainder of the bench seat includes a pair of wood members, the pair of wood members forming the removable segment being interconnected rigidly by a pair of cleats to retain them in assembled spaced relation, and an alignment block received in the space between the end portions of the removable wood members and between the adjacent ends of the wood members forming the remainder of the bench seat to retain the removable bench seat segment in alignment with the remainder of the bench seat.

4. A table comprising a table top having a continuous periphery, a bench seat extending around the periphery of the table with the table and bench seat being interconnected and supported from a support surface, said bench seat being continuous and including at least one removable segment, means detachably supporting the removable segment from the bench seat to enable removal of the removable bench segment to provide access to the periphery of the table top by a wheelchair or a straightback or similar chair, and an extension on the periphery of the portion of the table top in alignment with the removable bench seat segment to provide a radial extension for association with a wheelchair or chair to enable the occupant of a wheelchair or chair to have better access to a table top surface.

5. A table comprising a table top having a continuous periphery, a bench seat extending around the periphery of the table with the table and bench seat being interconnected and supported from a support surface, said bench seat being continuous and including at least one removable segment, means detachably supporting the removable segment from the bench seat to enable removal of the removable bench segment to provide access to the periphery of the table top and bench seat being of polygonal construction with the removable segment of the bench seat defining one edge segment of the bench seat.

6. The structure as defined in claim 5 wherein an extension on the periphery of the portion of the table top in alignment with the removable bench seat segment provides a radial extension for association with a wheelchair or chair to enable the occupant of a wheelchair or chair to have better access to a table top surface.

7. The structure as defined in claim 6 wherein said bench seat is supported by a plurality of radial frame members with the removable bench seat segments being connected to the outer end portions of two adjacent radial frame members said means rotatably supporting the bench segments including a loop-type bracket on the opposed surfaces of the radial frame members, each of said removable seat segments including a depending bracket in interlocking engagement with the loop-type bracket on the frame members to enable the removable seat segments to be retained in place, said removable seat segment including a pair of wood members, the remainder of the bench seat including a pair of wood members, the pair of wood members forming the removable segment being interconnected rigidly by a pair of cleats to retain them in assembled spaced relation, and an alignment block received in the space between the end portions of the removable wood members and between the adjacent ends of the wood members forming the remainder of the bench seat to retain the removable bench seat segment in alignment with the remainder of the bench seat.

8. A table comprising a table top, means supporting said table top from a support surface, a bench seat positioned below and outwardly of the periphery of the table top to enable access to the table top by occupants of the bench seat, means supporting the bench seat from the table with the bench seat forming a continuous peripheral support for the occupants and a continuous barrier to access to the periphery of the table top, the improvement comprising said bench seat including at least one removable segment to enable radial access to the periphery of the table top by an occupant of a wheelchair, straightback chair or similar movable chair, and means removably supporting said removable segment of the bench seat from the means supporting the bench seat.

* * * * *